US009253569B2

(12) United States Patent
Florian et al.

(10) Patent No.: US 9,253,569 B2
(45) Date of Patent: Feb. 2, 2016

(54) SYSTEM AND METHOD FOR A CANCELATION CIRCUIT

(71) Applicant: Infineon Technologies AG, Neubiberg (DE)

(72) Inventors: Wilfried Florian, Villach (AT); Luca Valli, Besana in Brianza MB (IT); Richard Gaggl, Poertschach am (AT)

(73) Assignee: Infineon Technologies AG, Neubiberg (DE)

( * ) Notice: Subject to any disclaimer, the term of this patent is extended or adjusted under 35 U.S.C. 154(b) by 193 days.

(21) Appl. No.: 14/137,295

(22) Filed: Dec. 20, 2013

(65) Prior Publication Data

US 2015/0181335 A1 Jun. 25, 2015

(51) Int. Cl.
*H04R 3/02* (2006.01)

(52) U.S. Cl.
CPC ..... *H04R 3/02* (2013.01)

(58) Field of Classification Search
None
See application file for complete search history.

(56) References Cited

U.S. PATENT DOCUMENTS

| | | | | |
|---|---|---|---|---|
| 4,979,218 | A * | 12/1990 | Strahm | H03H 11/32 330/258 |
| 6,580,797 | B1 * | 6/2003 | Papadopoulos | H03F 3/183 381/111 |
| 8,600,079 | B2 * | 12/2013 | Kimura | H04B 15/005 381/111 |
| 2007/0076904 | A1 | 4/2007 | Deruginsky et al. | |
| 2010/0166228 | A1 * | 7/2010 | Steele | A61B 8/4444 381/113 |
| 2010/0254544 | A1 * | 10/2010 | Kimura | H04B 15/005 381/94.1 |
| 2015/0016636 | A1 | 1/2015 | Florian et al. | |

FOREIGN PATENT DOCUMENTS

| | | | |
|---|---|---|---|
| JP | 2007508755 | A | 4/2007 |
| KR | 1019970019137 | | 4/1997 |
| KR | 100835638 | B1 | 6/2008 |
| WO | 2005011108 | A2 | 2/2005 |

* cited by examiner

*Primary Examiner* — Paul Huber
(74) *Attorney, Agent, or Firm* — Slater & Matsil, L.L.P.

(57) ABSTRACT

In accordance with an embodiment, a cancelation circuit includes a current mirror and a low pass filter. The current mirror includes an input terminal configured to accept an input current comprising a first noise signal, a first mirrored output and a second mirrored output. The low pass filter includes an input coupled to the first mirrored output and an output coupled to the second mirrored output. A sum of a current from the second mirrored output and a current of from the output of the low pass filter includes a phase-inverted version of the first noise signal.

21 Claims, 4 Drawing Sheets

SYSTEM AND METHOD FOR A CANCELATION CIRCUIT

TECHNICAL FIELD

The present disclosure relates generally to an electronic device, and more particularly to a system and method for a cancelation circuit.

BACKGROUND

Audio microphones are commonly used in a variety of consumer applications such as cellular telephones, digital audio recorders, personal computers and teleconferencing systems. In particular, lower-cost electret condenser microphones (ECM) are used in mass produced cost sensitive applications. An ECM microphone typically includes a film of electret material that is mounted in a small package having a sound port and electrical output terminals. The electret material is adhered to a diaphragm or makes up the diaphragm itself.

Another type of microphone is a microelectro-mechanical Systems (MEMS) microphone, in which a pressure sensitive diaphragm is etched directly onto an integrated circuit. As such, the microphone is contained on a single integrated circuit rather than being fabricated from individual discrete parts.

Most ECM and MEMS microphones also include a preamplifier that can be interfaced to an audio front-end amplifier via a cord and plug for a target application such as a cell phone or a hearing aid. In many cases, the interface between the preamplifier and front-end amplifier is a three-wire interface coupled to a power terminal, signal terminal and ground terminal. In some systems, however, a two-wire interface is used in which the power and signal terminals are combined into a single wire, thereby reducing the cost of the system by using two wires instead of three wires.

Combining a power and signal interface into a single interface, however, poses a number of design challenges with respect to maintaining good audio performance in the presence of circuit noise, power supply noise and disturbances.

SUMMARY OF THE INVENTION

In accordance with an embodiment, a cancelation circuit includes a current mirror and a low pass filter. The current mirror includes an input terminal configured to accept an input current comprising a first noise signal, a first mirrored output and a second mirrored output. The low pass filter includes an input coupled to the first mirrored output and an output coupled to the second mirrored output. A sum of a current from the second mirrored output and a current of from the output of the low pass filter includes a phase-inverted version of the first noise signal.

BRIEF DESCRIPTION OF THE DRAWINGS

For a more complete understanding of the present invention, and the advantages thereof, reference is now made to the following descriptions taken in conjunction with the accompanying drawings, in which.

Corresponding numerals and symbols in different figures generally refer to corresponding parts unless otherwise indicated. The figures are drawn to clearly illustrate the relevant aspects of the preferred embodiments and are not necessarily drawn to scale. To more clearly illustrate certain embodiments, a letter indicating variations of the same structure, material, or process step may follow a figure number.

DETAILED DESCRIPTION OF ILLUSTRATIVE EMBODIMENTS

The making and using of the presently preferred embodiments are discussed in detail below. It should be appreciated, however, that the present invention provides many applicable inventive concepts that can be embodied in a wide variety of specific contexts. The specific embodiments discussed are merely illustrative of specific ways to make and use the invention, and do not limit the scope of the invention.

The present invention will be described with respect to preferred embodiments in a specific context, a system and method for a microphone preamplifier that may be used in acoustic systems. Embodiments of the present invention may also be applied to other systems and applications utilizing bias generators and/or systems in which a common correlated noise source or disturbance affects multiple signal paths. Target applications include, but are not limited to, audio systems, communications systems, and control systems.

In an embodiment, a two-wire microphone is implemented using an amplifier coupled to an acoustic transducer. Instead of using a separate dedicated output pin for the audio output of the amplifier, the power supply current of the amplifier is made to be proportional to the amplifier audio signal. Accordingly, the two-wire microphone may be coupled to a system using only two connections, namely a ground connection and a power supply connection that also carries the audio signal as well as the current used to power the amplifier and acoustic transducer. Because the single output also carries the supply current, any noise or disturbances present within this supply current may sum with the audio signal and reduce the fidelity of the amplified signal.

One such noise contributor is the noise generated by the amplifier's bias generator. In some circumstances, noise produced by a reference voltage or current generator used to produce bias current within the circuit is replicated in multiple bias branches within the circuit. In accordance with various embodiments, noise of bias currents and voltage references is sensed at a node where it is not mixed with the signal and a cancelation current is produced and summed along with the supply current of the amplifier. Such a cancelation current contains an inverted version of the replicated noise, such that the sum of the replicated noise and the cancelation current is small or close to zero.

Figure 1A:
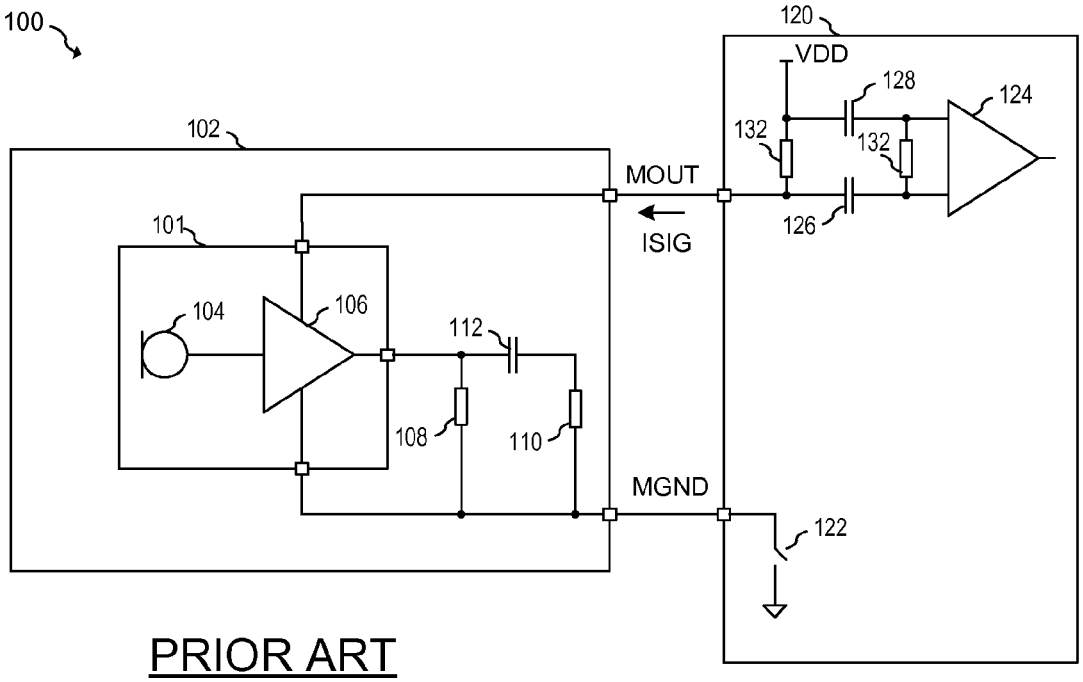
PRIOR ART FIG. 1a
FIGS. 1*a-b* illustrate a conventional microphone amplification systems.

FIG. 1*a* illustrates a conventional two-wire microphone amplification system 100 that includes microphone unit 102 coupled to main unit 120. Main unit 120 may be contained, for example, on the motherboard of a personal computer, or as a sub circuit on an audio processing chip. Microphone unit 102 includes microphone circuit 101 having acoustic transducer 104 and amplifier 106. Within microphone unit 102, a passive network that includes resistor's 108 and 110 and capacitor 112 are coupled between the output of amplifier 106 and microphone unit ground node MGND. Signals MOUT and MGND form the two-wire microphone interface. Signal MGND is coupled to switch 122, and signal MOUT is coupled to amplifier 124 via AC coupling capacitor 126. Switch 122 may be closed, for example, as a result of a microphone plug containing signals MOUT and MGND being plugged into a receptacle coupled to signals MOUT and MGND using circuits and systems known in the art.

In two wire microphone amplification system 100, amplifier 106 and/or transducer 104 receive their power from and transmits the electrical representation of an acoustic signal via MOUT. Power is provided to amplifier 106 via resistor 132 on main unit 120, while amplifier 124 is configured to amplify the AC signal presence on line MOUT. In system 100, amplifier 106 converts the output of the acoustic transducer to a voltage at node OUT, which drives resistors 108 and 110 and capacitor 112. The signal current ISIG that drives resistors 108 and 110 and capacitor 112 is provided via line MOUT. The operating point for the main unit is determined by the voltage drop across resistor 132 with the given DC load current at the output of the amplifier 106 and the supply current of the microphone. A voltage is developed at an input of amplifier 124 as the result of signal current ISIG being applied to resistor 132. Capacitor 126 couples the signal voltage at line MOUT to a first input of amplifier 124, while capacitor 128 couples the signal voltage at on-chip power supply VDD at a second input of amplifier 124. The AC signal amplitude for amplifier 124 is determined by the relation of parallel connection of resistors 132 in main unit 120 to resistors 108 and 110 at the output of microphone circuit 101.

Figure 1B:
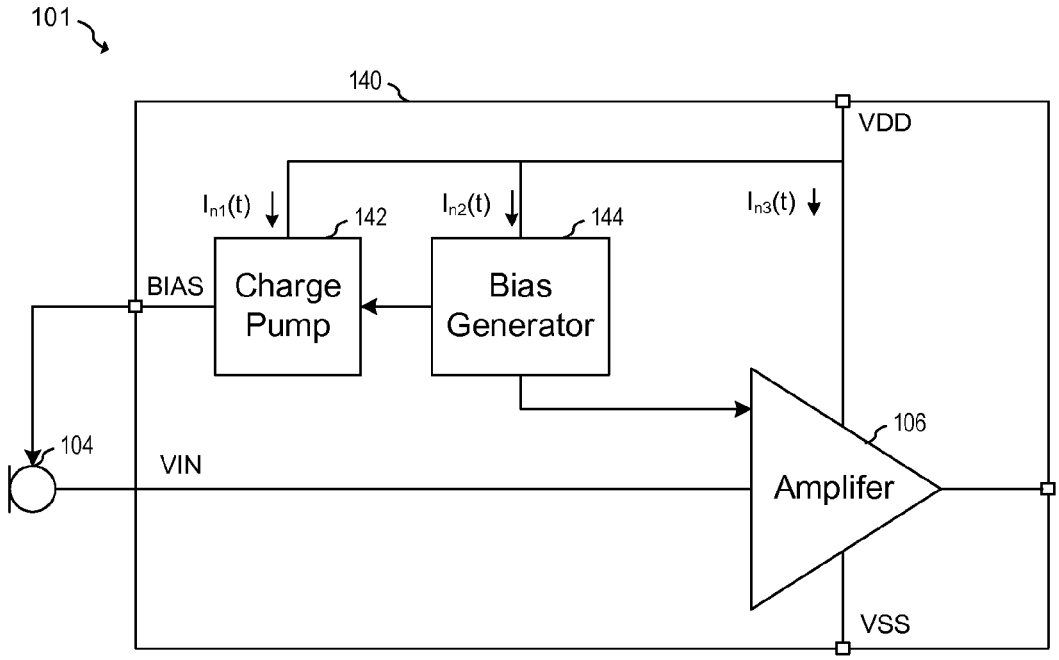
FIG. 1b PRIOR ART

FIG. 1*b* illustrates a more detailed block diagram of conventional microphone circuit 101 that includes transducer 104, charge pump 142, bias generator 144, and amplifier 106. Depending on the specific microphone type, charge pump 142 produces a boosted power supply voltage for acoustic transducer 104, and amplifier 106 provides amplification of the electrical output signal of acoustic transducer 104. Bias generator 144 provides reference currents and voltages for amplifier 106 and other circuit elements that may be present on amplifier IC 140. As shown, any biasing in the charge pump 142 produces noise current $I_{n1}(t)$, bias generator 144 produces noise current $I_{n2}(t)$, and amplifier 106 produces noise current $I_{n3}(t)$, the sum of which contribute to the noise of signal current ISIG, and which may degrade the quality of the amplified audio signal in some cases.

Figure 2:
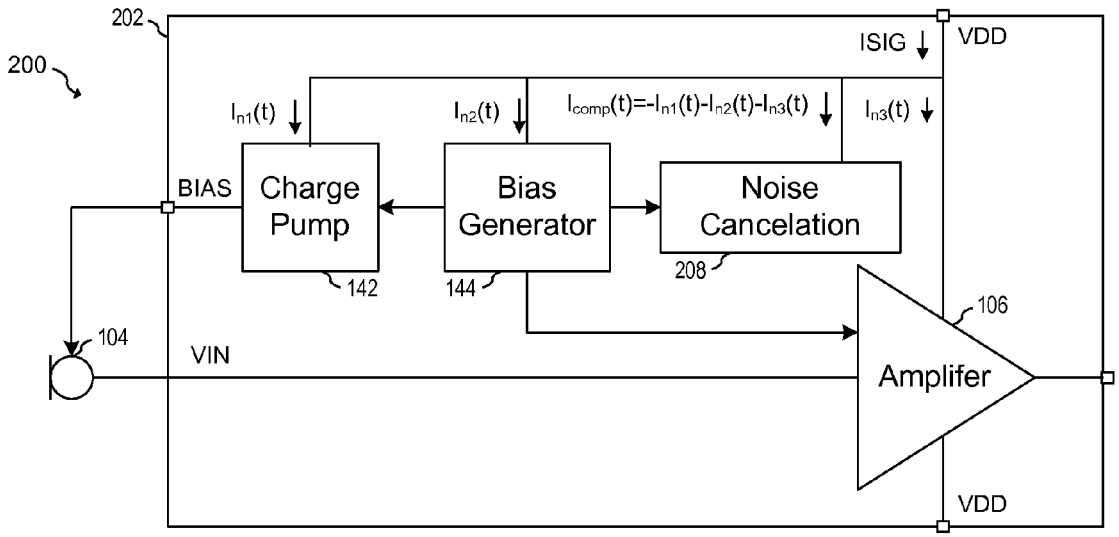
FIG. 2 illustrates an embodiment microphone amplification system.

FIG. 2 illustrates an embodiment microphone amplification system 200 that includes acoustic transducer 104 and amplifier IC 202. Similar to amplifier IC 140 shown in FIG. 1*b*, amplifier IC 202 includes charge pump 142, bias generator 144 and amplifier 106 generate noise currents $I_{n1}(t)$, $I_{n2}(t)$ and $I_{n3}(t)$ respectively. In an embodiment, noise cancelation circuit 208 is further included that produces current $I_{comp}(t)=-I_{n1}(t)-I_{n2}(t)-I_{n3}(t)$, which is an inverted version of the sum of noise signals $I_{n1}(t)$, $I_{n2}(t)$ and $I_{n3}(t)$. By summing $I_{comp}(t)$ with $I_{n1}(t)$, $I_{n2}(t)$ and $I_{n3}(t)$, the effective noise of output current ISIG may be canceled or attenuated. In some embodiments, amplifier 106 may be implemented, for example, using circuits and methods described in co-pending U.S. patent application Ser. No. 13/941,273 entitled System and Method for a Microphone Amplifier, filed on Jul. 12, 2013, which application is incorporated by reference herein in its entirety.

Noise cancelation circuit 208 may produce compensation current $I_{comp}(t)$ by determining an AC component of the reference current produced by bias generator 144. In some embodiments, noise present in the reference current produced by bias generator 144 may be replicated among the various circuits that use bias generator 144 as a reference. The higher the magnitude of total bias current that is reference to bias generator 144, the higher the noise that may be present.

Figure 3:
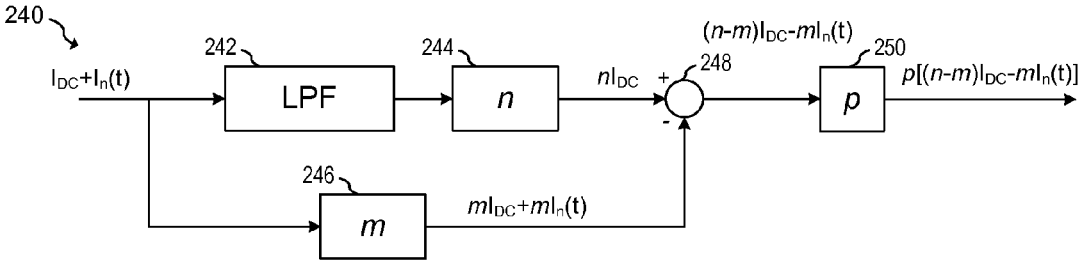
FIG. 3 illustrates a block diagram of an embodiment noise cancelation system.

FIG. 3 illustrates a block diagram of embodiment noise cancelation circuit 240 that shows the conceptual operating principle of some embodiment noise cancelation circuits. As shown, an input current represented by DC component $I_{DC}$ and noise component $I_n(t)$ is low pass filtered by low pass filter 242 and is optionally scaled by n scaling block 244 to produce current $nI_{DC}$. In a parallel branch the input current is also scaled by m using m scaling block 246 to produce current $mI_{DC}+m\ I_n(t)$. Current $mI_{DC}+m\ I_n(t)$ is then subtracted from $nI_{DC}$ to produce output current $(n-m)I_{DC}-m\ I_n(t)$ using subtractor 248. As can be seen, the polarity of the noise of the output current $-mI_n(t)$ is inverted with respect to the polarity of the noise of the input current $I_n(t)$. The magnitude of the inverted noise current may be adjusted by selecting m or by scaling the output of subtractor 248 with p scaling block 250 to produce output current $p(n-m)I-_{DC}-mp\ I_n(t)$.

Figure 4:
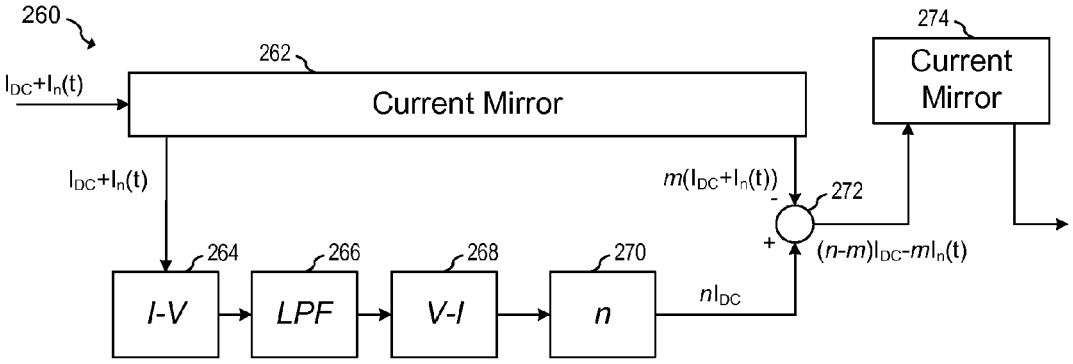
FIG. 4 illustrates a further embodiment noise cancelation system.

FIG. 4 illustrates a block diagram of noise cancelation circuit 260 that may be used in embodiment systems. In an embodiment, input current $I_{DC}+I_n(t)$, which may be produced using bias generation techniques known in the art, is coupled to an input of current mirror 262. A mirrored output current is converted to a voltage using current-to-voltage converter 264, low pass filtered using low pass filter 266 and converted back into a current using voltage-to-current converter 268. In some embodiments, the function of current to voltage converter 264, low pass filter 266 and voltage-to-current converter 268 may be implemented using a current mirror and a RC filter as explained below. The output of voltage-to-current converter 268 is scaled using block 270 and subtracted from a second output of current mirror 262 to produce output current $(n-m)\ I_{DC}-mI_n(t)$. This subtraction is represented by subtractor 272, however, in many embodiments, subtraction of current may be accomplished by coupling the outputs of at least two current sources to a same node. In one specific embodiment, n is set to be about two, and m is set to be about one. Alternatively, n and m may be set to other values. Since the DC component and the noise component have different coefficients, it is possible to optimize both the DC current consumption and the noise cancelation independently. An additional current mirror 274 may be used to scale the output current. In some embodiments, the mirror ratio of current mirror 274 may be set such that noise current $-mI_n(t)$ is scaled to compensate for other noise present in the system due to bias currents having a noise component due to $+I_n(t)$ generated by a voltage or current reference circuit.

Figure 5:
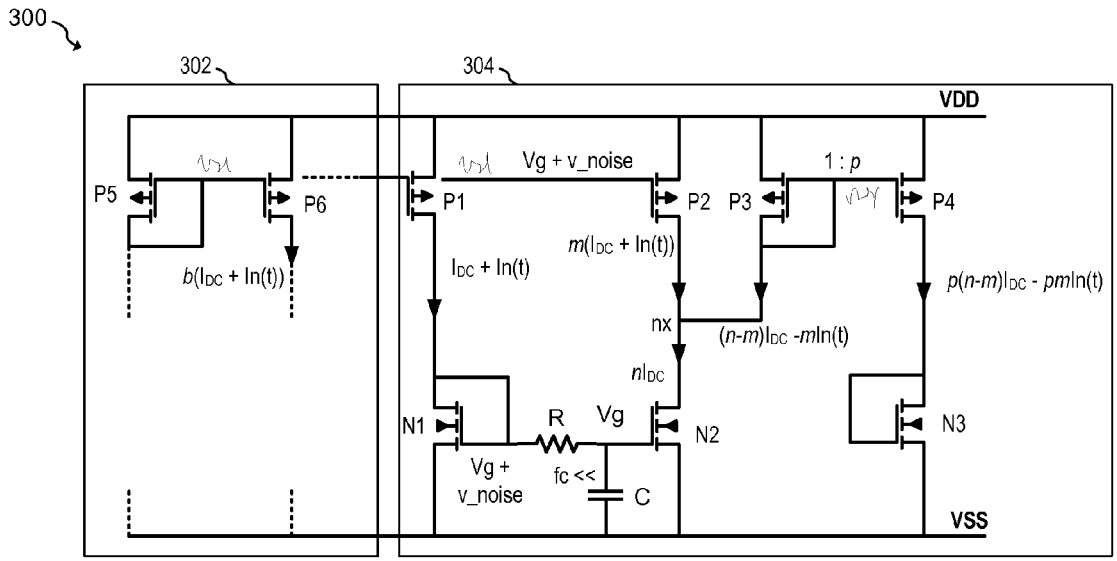
FIG. 5 illustrates a transistor level schematic of an embodiment noise cancelation system.

FIG. 5 illustrates an example transistor level circuit schematic of an embodiment noise cancelation system 300. Block 302 that shows a PMOS current mirror made of PMOS transistors P5 and P6 is representative of the bias circuitry of various analog circuits such a bias generators, bandgap circuits, amplifiers, biasing of charge pumps and other circuits. Block 304 represents the core noise cancelation circuit. Diode connected transistor P5 accepts noisy reference current $Iin=I_{DC}+In(t)$ and mirrors Iin to PMOS transistors P1, P2 and P6. It should be understood that in some practical embodiments, PMOS transistors P5 may mirror Iin to many other PMOS transistors and/or there may be other bias current paths that are referenced to currents and voltages having noise correlated to In(t).

In an embodiment, the current noise In(t) present within Iin is converted to a voltage Vg+v_noise at the common gate connection of PMOS transistors P1, P2 and P6. PMOS transistor P1 then converts voltage Vg+v_noise on the common gate connection back to a current $I_{DC}$+In(t), which is again converted to a voltage Vg+v_noise at the gate of diode connected NMOS transistors N1. A RC low pass filter with a very low corner frequency fc attenuates noise voltage v_noise, thereby resulting in a low noise or a noiseless bias-voltage Vg at the gate of NMOS transistor N2. In some embodiments, corner frequency fc may be less than 1 Hz in order to provide a low noise output current in the audio range. However, high corner frequencies may be used in alternative embodiments depending on the specifications of the particular system. In an embodiment, NMOS transistor N2 has a width to length (W/L) ratio that is n times the (W/L) ratio of NMOS transistor N1, thereby scaling current $I_{DC}$ by a factor of n to produce a low noise or noiseless current n×$I_{DC}$. PMOS transistor P2 mirrors a current containing m($I_{DC}$+In(t)) into node nx along with the current n×$I_{DC}$ produced by NMOS transistor N2. Fulfilling Kirchhoff's law results in a current term (n−m) $I_{DC}$−mIn(t) that flows though diode connected PMOS transistor P3 and is mirrored to PMOS transistor P4. As can be seen, the polarity of noise current −In(t) is inverted with respect to the polarity of noise current −In(t) present in PMOS transistors P1, P2, P5 and P6.

In one example, the W/L ratio of PMOS transistor P4 is p times the W/L ratio of PMOS transistor P3, such that drain current of PMOS transistor P4 is p times the drain current of PMOS transistor P3. Optional diode connected transistor N3 is provided to sink the current from transistor P4. In alternative embodiments, the drain of PMOS transistor P4 may be connected directly to VSS or another device such as a diode, resistor, a transistor of various types, or other device.

The magnitude of the total inverted polarity noise current −In(t) may be adjusted by selecting a mirror ratio 1:m and p in order to cancel current noise correlated to In(t) at the VDD rail and taking into account that the additional noise from P3 and P4 is smaller than the one that is being canceled. The error coefficient (n−m) may be chosen so that the DC current of PMOS transistor P3 is very low (i.e. about 100 nA).

It should be further understood that in alternative embodiments of the present invention, various other scaling factors, mirror ratios and/or corner frequencies greater than 1 Hz may be used depending on the particular application and its specifications. It should be further understood that other transistor types may be used to implement the circuitry shown in FIG. 5. In some embodiments, noise cancelation circuit can be done by filtering on the high side (i.e., by coupling the RC filter to PMOS devices) and performing current subtraction on the low side.

Figure 6:
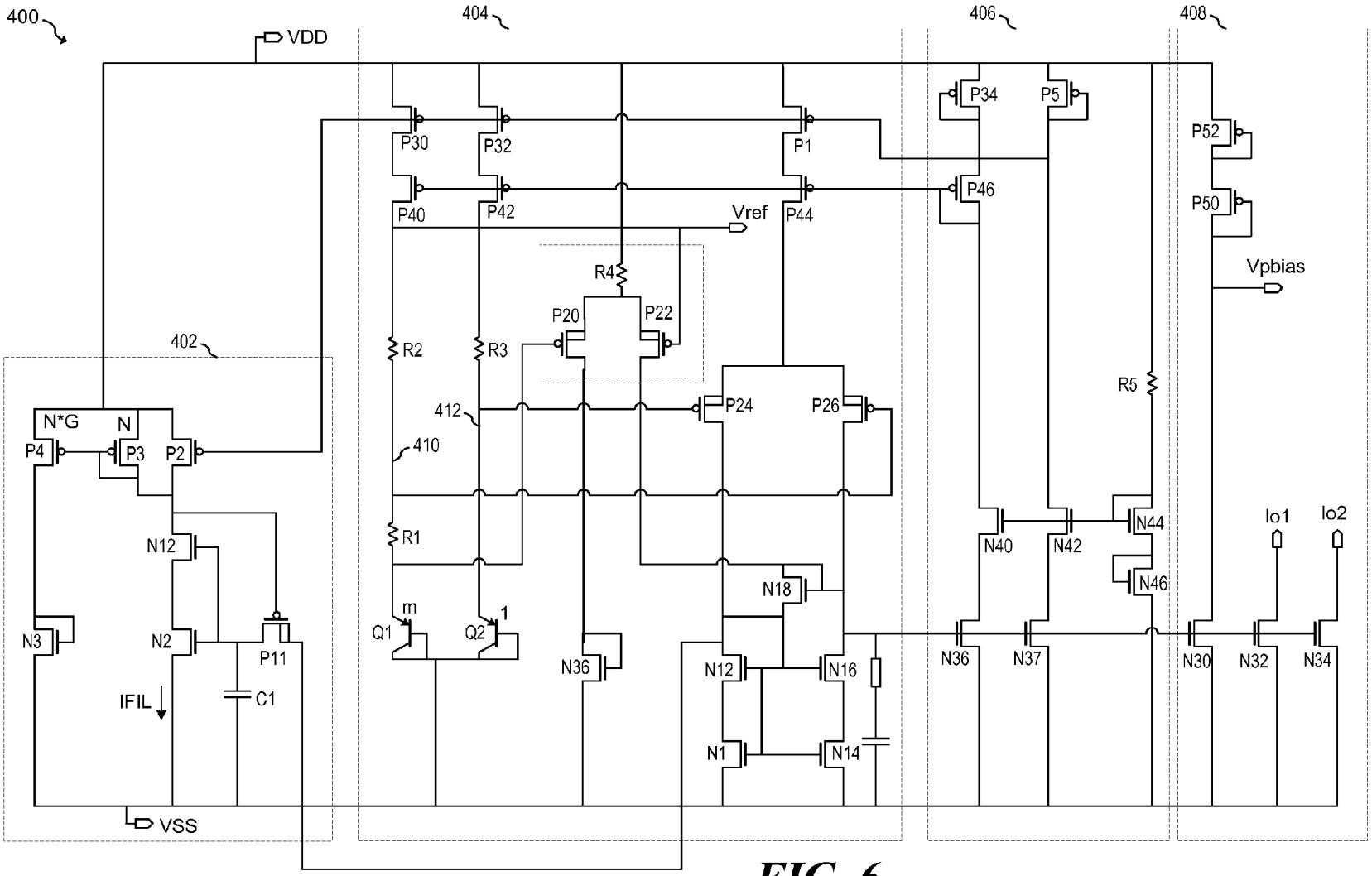
FIG. 6 illustrates a schematic of an embodiment bias generator with noise cancelation.

FIG. 6 illustrates an embodiment bias generation circuit 400 that implements embodiment noise cancelation techniques. Bias generation circuit 400 includes bandgap reference generator 404, biasing transistors 406 that support the operation of bandgap reference generator 404, output bias transistors 408 and an embodiment noise cancelation circuit 402. In some embodiments bias generation circuit 400 may be used to bias a microphone amplifier. Bandgap circuit 404 includes a differential pair implemented with PMOS input transistors P24 and P26 that causes the voltages at nodes 410 and 412 to be substantially the same via feedback. This is accomplished by adjusting the current through PMOS transistors P30 and P32 via current mirrors formed by NMOS transistors N14 and N37 and PMOS transistor P5. Using known bandgap reference techniques, a current proportional to absolute temperature (PTAT) flows through resistors R1, R2 and R3, thereby producing PTAT voltages that are summed with the base-emitter voltages of PNP transistors Q1 and Q2, which are inversely proportional to temperature. By proper selection of resistors R1, R2 and R3, as well as area ratios of PNP transistors Q1 and Q2, voltage Vref may be made to be substantially independent of temperature. The PMOS differential pair made of PMOS transistors P20 and P22, as well as resistor R4 and NMOS transistor N18 may be employed to ensure that bandgap circuit 404 starts up when power is first applied.

Biasing transistor block 406 include diode connected reference PMOS transistor P5 that is used to bias PMOS current mirror transistors P1, P30 and P32, as well as PMOS transistor P2 within noise cancelation circuit 402. Transistor P34 and P46 bias PMOS cascode devices P40, P42, P44 and P46, while transistors N44 and N46 along with resistor R5 bias NMOS cascode devices N40 and N42. Output bias transistor block 408 represents bias outputs that may be used by other circuit blocks (not shown). For example, NMOS transistors N32 and N34 provide bias currents Io1 and Io2, while PMOS transistors P50 and P52 are used to generate bias voltage Vpbias. It should be understood that the circuit topology of FIG. 6 is just one of many example circuit topologies that may be used in embodiment systems. In alternative embodiments, different reference generator topologies and/or different current source and biasing topologies may be used. In some systems, cascode devices may be biased differently and/or may not be used at all depending on the particular embodiment and its specifications.

Depending on the transistors size of the transistors and their bias currents, the transistors present within bandgap circuit 404 and biasing transistors 406 may produce white noise. The generated noise may also have a Flicker noise component that has a 1/f characteristic. This flicker noise component may have a power that is inversely proportional to the areas of the respective transistors may also be generated. Such noise may manifest itself as a noisy current that flows through power supply pin VDD from biasing branches including PMOS current mirror transistors P1, P32 and P30 that are biased by common diode connected PMOS transistor P5. A portion of the noise present in these current may be correlated. Such correlation may occur, for example, when a noisy current present in a reference branch is mirrored to one or more further current branches. In some embodiments, the differential pair formed by PMOS devices P24 and P26 is be configured to have a large transconductance (gm), and the current though the various current mirrors are made as small as possible in order to lower noise.

Noise cancelation circuit 402 creates a filtered current by low pass filtering the gate voltage of NMOS transistor N1 using PMOS transistor P11 as a resistance and capacitor C1 as a capacitance. Alternatively, other devices including, but not limited to a NMOS transistor, one or more reversed bias, and an ohmic resistor diode, may be used to implement the resistance. In some embodiments, the corner frequency of the low pass filter is about 1 Hz; however, a different corner frequency may be used in alternative embodiments. The low pass filtered gate voltage of NMOS transistor N1 is then used to drive NMOS transistor N2 to produce a filtered current IFIL. Filtered current IFIL is subtracted from a noise current mirrored to PMOS transistors P2 such that an inverted noisy current is drawn from diode-connected transistor P3 as described in embodiments above. The current of PMOS transistor P3 is mirrored to PMOS transistor P4. The size ratio of PMOS transistor P3 to PMOS transistor P4 is G:1. The factor of G may be chosen such that the inverted noise current flowing through PMOS transistors P3 and P4 is substantially equal to the non-inverted noise current flowing though the remaining branches of the circuit.

Noise cancelation circuit 402 provides noise cancelation at frequencies above the corner frequency of the low pass filter formed by PMOS transistor P11 and capacitor C1. In some embodiments, for example, that are used to in audio circuits, the circuit may be configured to provide noise cancelation in the audio bandwidth. Alternatively, other noise cancelation bandwidths may be selected according to the particular application and its specifications.

Figure 7:
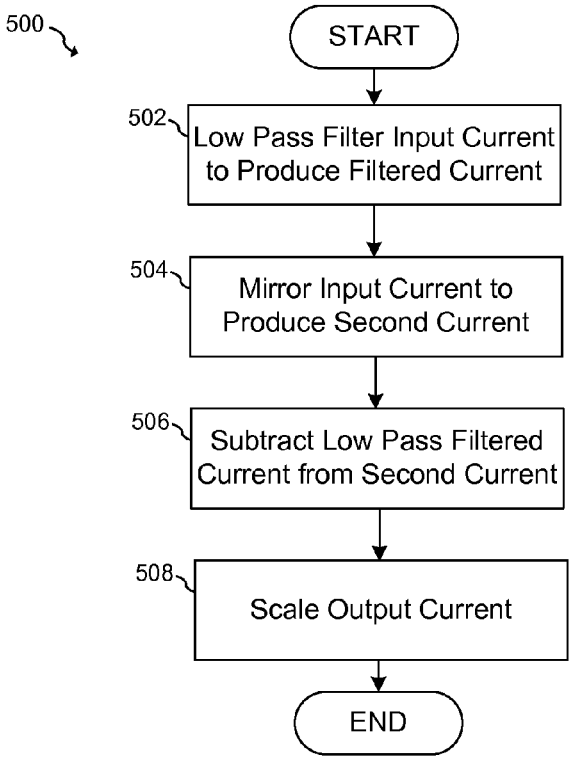
FIG. 7 illustrates a block diagram of an embodiment method.

FIG. 7 is an embodiment block diagram of embodiment noise cancelation method 500. In step 502, a noisy input current is low pass filtered to produce a filtered current. As discussed above with respect to other embodiments, this noisy current may be produced, for example, by bias generation circuitry. The noise in the input current may be correlated to other noise present in other bias currents branches within the circuit. In step 504, the input current is mirrored to produce a second noisy current, and in step 506, the low pass filtered current is subtracted from the second current to produce an inverted current having a noise component with a phase that is opposite from the noise current of the input current. The net output current that includes the inverted noise current may be scaled in order to cancel out or compensate for the non-inverted noise current present within the embodiment system in step 508.

Advantages of some embodiments include the ability to provide a two-wire microphone that provides a low noise output by reducing the effects of correlated current noise generated by the microphone's bias generator. Systems that utilize embodiment noise cancelation circuits may further benefit from low power consumption and small die size and circuit size because of the ability to use otherwise noisy small transistors and low bias currents.

Further advantages of embodiments in which noise reduction is be achieved by adding one or more noise cancelation circuits is the ability to improve noise performance without the changing block and circuit architecture of functional circuits.

In accordance with an embodiment, a cancelation circuit includes a current mirror and a low pass filter. The current mirror includes an input terminal configured to accept an input current comprising a first noise signal, a first mirrored output and a second mirrored output. The low pass filter includes an input coupled to the first mirrored output and an output coupled to the second mirrored output. A sum of a current from the second mirrored output and a current of from the output of the low pass filter includes a phase-inverted version of the first noise signal.

The cancelation circuit may further includes a current to voltage converter coupled between the first mirrored output and the input of the low pass filter, and a voltage to current converter coupled to the output of the low pass filter. In an embodiment, the current to voltage converter includes a first diode connected transistor, and the voltage to current converter includes a second transistor having a control node coupled to the first diode connected transistor via the low pass filter. The low pass filter is implemented using a resistance coupled to a capacitor.

In some embodiments, the cancelation circuit further includes a current scaling circuit having an input coupled to the output of the low pass filter. This current scaling circuit may include, for example, a current mirror. The cancelation circuit may further include additional circuitry biased with a reference current having the first noise signal, such that the current scaling circuit is configured to produce an amount of the phase-inverted version of the first noise signal that substantially cancels the first noise signal within the cancelation circuit and the additional circuitry. This additional circuitry may include, for example, a microphone amplifier and a bias generator. In an embodiment, the microphone amplifier includes a 2-wire microphone amplifier configured to produce an audio output signal at a power supply terminal.

In accordance with a further embodiment, a method of canceling noise within a circuit includes low pass filtering an input current having a first DC component and a first AC component to produce a low pass filtered current; mirroring the input current to produce a second current; and subtracting the low pass filtered current from the second current to produce an output current having a second DC component and a second AC component. The second AC component has an inverted phase with respect to the first AC current. The method may further include scaling the second AC component. In some embodiments, the second AC component is scaled to substantially cancel the first AC component.

In an embodiment, the method further includes biasing a further circuit using a reference current comprising the first AC component, wherein the second AC component is further scaled to cancel the AC component within a bias generator and a further circuit coupled to the bias generator. The further circuit may include a microphone amplifier having an audio output at a power supply terminal, and the method may further include amplifying an output of a microphone using the microphone amplifier.

In accordance with a further embodiment, an integrated circuit includes a bias generator configured to produce a first current having a first DC current component and a first AC current component, and an amplifier coupled to the bias generator, wherein a bias current of the amplifier includes the first AC current component. The integrated circuit further includes a cancelation circuit coupled to the bias generator configured to produce a second AC current component having an inverted phase with respect to the first AC component.

In an embodiment, the amplifier, bias generator and the cancelation circuit are coupled to a first power supply terminal, and the amplifier is configured to produce an audio signal at the first power supply terminal. In some embodiments, the integrated circuit includes a 2-wire microphone interface.

In an embodiment, the cancelation circuit includes a low pass filter circuit configured to filter the first AC current component from the bias generator, and a current mirror having an input coupled to the bias generator and an output coupled to an output of the low pass filter, which may include a resistance, a capacitance, and an output transistor having a control terminal coupled to the resistance and the capacitance. The cancelation circuit may further include a scaling circuit coupled to the output of the low pass filter. This scaling circuit may be implemented, for example, using a current mirror.

In some embodiments, the bias generator, the amplifier and the cancelation circuit are coupled to a first power supply terminal, and the cancelation circuit is configured to a produce the second AC current component having a magnitude substantially equal to a magnitude of the first AC component, such that the second AC current component cancels the first AC component at the first power supply terminal.

While this invention has been described with reference to illustrative embodiments, this description is not intended to be construed in a limiting sense. Various modifications and combinations of the illustrative embodiments, as well as other embodiments of the invention, will be apparent to persons skilled in the art upon reference to the description.

What is claimed is:

1. A cancelation circuit comprising:

a current mirror comprising an input terminal configured to accept an input current comprising a first noise signal, a first mirrored output and a second mirrored output; and a low pass filter having an input coupled to the first mirrored output and an output coupled to the second mirrored output, wherein a sum of a current from the second mirrored output and a current of from the output of the low pass filter comprises a phase-inverted version of the first noise signal.

2. The cancelation circuit of claim 1, further comprising:

a current to voltage converter coupled between the first mirrored output and the input of the low pass filter; and a voltage to current converter coupled to the output of the low pass filter.

3. The cancelation circuit of claim 2, wherein:

the current to voltage converter comprises a first diode connected transistor;

the voltage to current converter comprises a second transistor having a control node coupled to the first diode connected transistor via the low pass filter; and the low pass filter comprises a resistance coupled to a capacitor.

4. The cancelation circuit of claim 1, further comprising a current scaling circuit having an input coupled to the output of the low pass filter.

5. The cancelation circuit of claim 4, wherein the current scaling circuit comprises a current mirror.

6. The cancelation circuit of claim 4, further comprising additional circuitry biased with a reference current having the first noise signal, wherein the current scaling circuit is configured to produce an amount of the phase-inverted version of the first noise signal that substantially cancels the first noise signal within the cancelation circuit and the additional circuitry.

7. The cancelation circuit of claim 6, wherein the additional circuitry comprises a microphone amplifier and a bias generator.

8. The cancelation circuit of claim 7, wherein the microphone amplifier comprises a 2-wire microphone amplifier configured to produce an audio output signal at a power supply terminal.

9. A method of canceling noise within a circuit, the method comprising:

low pass filtering an input current comprising a first DC component and a first AC component to produce a low pass filtered current;

mirroring the input current to produce a second current; and subtracting the low pass filtered current from the second current to produce an output current having a second DC component and a second AC component, wherein the second AC component has an inverted phase with respect to the first AC component.

10. The method of claim 9, further comprising scaling the second AC component.

11. The method of claim 10, wherein the second AC component is scaled to substantially cancel the first AC component.

12. The method of claim 11, further comprising biasing a further circuit using a reference current comprising the first AC component, wherein the second AC component is further scaled to cancel the AC component within a bias generator and a further circuit coupled to the bias generator.

13. The method of claim 12, wherein the further circuit comprises a microphone amplifier having an audio output at a power supply terminal and the method further comprises amplifying an output of a microphone using the microphone amplifier.

14. An integrated circuit comprising:

a bias generator configured to produce a first current having a first DC current component and a first AC current component;

an amplifier coupled to the bias generator, wherein a bias current of the amplifier comprises the first AC current component; and a cancelation circuit coupled to the bias generator configured to produce a second AC current component having an inverted phase with respect to the first AC component.

15. The integrated circuit of claim 14, wherein:

the amplifier, bias generator and the cancelation circuit are coupled to a first power supply terminal; and the amplifier is configured to produce an audio signal at the first power supply terminal.

16. The integrated circuit of claim 14, wherein the integrated circuit comprises a 2-wire microphone interface.

17. The integrated circuit of claim 14, wherein the cancelation circuit comprises:

a low pass filter circuit configured to filter the first AC current component from the bias generator; and a current mirror having an input coupled to the bias generator and an output coupled to an output of the low pass filter.

18. The integrated circuit of claim 17, wherein the low pass filter comprises a resistance, a capacitance, and an output transistor having a control terminal coupled to the resistance and the capacitance.

19. The integrated circuit of claim 17, wherein the cancelation circuit further comprises a scaling circuit coupled to the output of the low pass filter.

20. The integrated circuit of claim 19, wherein the scaling circuit comprises a current mirror.

21. The integrated circuit of claim 14, wherein:

the bias generator, the amplifier and the cancelation circuit are coupled to a first power supply terminal; and the cancelation circuit is configured to a produce the second AC current component having a magnitude substantially equal to a magnitude of the first AC component, wherein the second AC current component cancels the first AC component at the first power supply terminal.

* * * * *